United States Patent [19]

Clarke

[11] Patent Number: 4,615,412

[45] Date of Patent: Oct. 7, 1986

[54] LADDER REST DEVICE

[76] Inventor: James B. Clarke, 120 Shepherds Hill, Harold Wood, Essex, England

[21] Appl. No.: 678,510

[22] PCT Filed: May 18, 1984

[86] PCT No.: PCT/GB84/00171

§ 371 Date: Nov. 19, 1984

§ 102(e) Date: Nov. 19, 1984

[87] PCT Pub. No.: WO84/04776

PCT Pub. Date: Dec. 6, 1984

[30] Foreign Application Priority Data

May 20, 1983 [GB] United Kingdom ..... 8313950
Aug. 22, 1983 [GB] United Kingdom ..... 8322497
Mar. 14, 1984 [GB] United Kingdom ..... 8406584

[51] Int. Cl.[4] ..... E06C 7/48

[52] U.S. Cl. ..... 182/214; 182/107; 182/121

[58] Field of Search ..... 182/214, 107, 108, 121, 182/122, 120, 129

[56] References Cited

U.S. PATENT DOCUMENTS 960,565 6/1910 Levander ..... 182/121
2,597,902 5/1952 Roketa ..... 182/214
3,072,218 1/1963 Peters ..... 182/214
4,121,692 10/1978 Morawski ..... 182/214
4,280,590 7/1981 Polizzi ..... 182/214
4,311,207 1/1982 Lurry ..... 182/214

FOREIGN PATENT DOCUMENTS 1193183 4/1959 France ..... 182/214

*Primary Examiner*—Reinaldo P. Machado
*Attorney, Agent, or Firm*—Kane, Dalsimer, Kane, Sullivan and Kurucz

[57] ABSTRACT

A ladder rest comprises interconnected yokes (12,13) which extend across the front or climbing side of an upper ladder section (8) and are mounted on rungs (18) of that ladder section by hooks (17). The yokes extend around the stiles (11) of the ladder and carry abutments (22) which engage a wall (24). The yokes are clear of the stiles of the ladder and of any guide furniture (10) on the lower ladder section, so as not to interfere with complete retraction of the ladder. The abutment portion (22) is below the level of the lower hook (17) at which load is applied from the ladder to the device to provide an advantageous geometry when the ladder is loaded and bows towards the wall.

15 Claims, 7 Drawing Figures

LADDER REST DEVICE

The invention relates to a device for use in resting an upper part of a ladder against a wall, for example to increase stability or to provide a stand off to support the ladder in a more useful working position, such as with its top free in front of a window or to enable the user to reach a gutter or other projecting architectural feature.

Conventionally, such devices are mounted on the top two rungs of a ladder and project laterally at the back of the ladder and rearwardly into abutment with the wall. It follows that when the device is fitted to the upper section of an extendible ladder below the top two rungs, the device interferes with the rungs on a lower section of the ladder when the ladder is retracted, thereby preventing complete retraction of a ladder.

In accordance with a primary aspect of the present invention, a device for use in resting an upper part of a ladder against a wall comprises a frame which is provided with means for mounting the frame on at least one rung of the ladder, the frame having first parts extending away from one another, in use, transversely across respective ones of the ladder stiles and second parts extending rearwardly from the first parts, in use, at the sides of the ladder and carrying means for abutment with a wall, characterised in that the mounting means and first frame parts are so arranged that, in use, the first parts cross the ladder stiles on the front climbing side of the ladder and when the device is mounted a few rungs down from the top of an upper section of an extendible ladder at a position below guide furniture on a lower ladder section when the ladder is retracted, the frame can ride past the lower section and guide furniture upon extension and retraction of the ladder.

A device of this construction is of particular utility when used on a conventional extendible ladder as it may be fitted at any position on the upper ladder section without interfering with any part of the lower ladder section or sections upon full retraction of the ladder. The frame may be arranged to be sufficiently spaced from the front and sides of the stiles of the ladder section to which it is fitted, to enable it to clear the stiles of one or more lower ladder sections and the hooks or other guide furniture on one or more lower ladder sections for guiding the stiles of the next upper ladder section. Alternatively, the frame mounting means may incorporate a degree of slack enabling the frame to ride over the guide furniture.

The frame is strengthened if the second parts of the frame are interconnected so that the frame completely surrounds a ladder to which it is fitted.

When working from a ladder, the user has one position at any given height from which to work, i.e. a particular rung. This means that the ladder has to be moved to avoid over-reaching sideways and the attendant risks. Also, if a ladder is used for a protracted period, the rungs are very uncomfortable and only minor relief is derived from using "D" rungs or square rungs.

In order to overcome this problem the second parts of the frame may incorporate staging whereby, in use, a user may stand on the staging. The staging may be at one side of the frame to support one or both feet of the user, but the arrangement is preferably symmetrical with staging at both sides of the frame. The staging provides greater comfort for the user and provides him with a wider reach.

Although the frame may be substantially rigidly mounted on a ladder, at least the rearwardly projecting parts of the frame may be pivotally mounted about a horizontal axis, in use parallel to the rungs of a ladder on which the device is mounted, so that these parts may be folded towards the back of the ladder, and a tension member may then be connected to these parts and arranged to engage a part of a ladder above the device to restrain the pivotally mounted parts in their rearwardly projecting working position.

The tension member is preferably flexible and may be a chain, rope etc. which is arranged to be secured to a rung and/or stile of a ladder above the device, or to pass over a rung above the device and down to a fixing point on the ladder. Letting out or taking in the flexible member will then cause the pivotally mounted parts to swing downwards or upwards towards, or even against, the back of the ladder, thereby facilitating storage of the ladder. The pivotal connection may be provided between the mounting means and a rung, but most simply the second rearwardly extending parts of the frame are pivotally mounted on the first parts which extend across the fronts of the ladder stiles.

The abutment means will normally be arranged to engage a wall at positions spaced laterally by a distance greater than the width of a ladder.

The abutment means may take various forms. Thus then may comprise fixed frictional abutment means, such as a rubber or other elastomeric buffer which will provide restraint against sliding sideways or down the wall. Equally, the abutment means may comprise wheel abutment means, such as a pair of laterally spaced wheels, which will facilitate extension and retraction of an extendible ladder. If the wheel peripheries are made of suitable material, the wheel abutment means may provide frictional restraint against lateral movement, but by themselves they will be incapable of frictionally restraining downward movement relatively to the wall, corresponding to outward slipping of the base of the ladder. These are advantages therefore if both fixed frictional and wheel abutment means are utilized. In that event the wheel may be mounted beneath the fixed frictional abutment means either or both of which may normally be in engagement with the wall so that if the angle of inclination of a ladder to the wall is reduced from a normal working angle to about 15°, the fixed abutment means will be disengaged from the wall. Conversely if the angle of the ladder to wall is increased corresponding to outward slip the wheels will be disengaged. Alternatively, the wheel abutment means may be urged resiliently to move rearwardly relatively to the frictional abutment means such that when no user is standing on the ladder the spring loading is strong enough to cause the wheel abutment means to project rearwardly beyond the fixed frictional abutment means, in preferential engagement with the wall, but when a user stands on the ladder, his additional weight causes the wheel abutment means to retract relatively to the fixed frictional abutment means, so that the latter is in working engagement with the wall.

In conventional ladder rest devices, the rearwardly projecting parts of the device extend from the ladder towards the wall substantially perpendicularly to the wall and the point of engagement of the abutment means with the wall is substantially at the same level as the position at which the load from the ladder is transmitted to the device. The effect of this is that as a user climbs the ladder below the device, he repeatedly causes the ladder to flex and bow convexly towards the wall. The inevitable result is that the rest device rocks downwards about the point of abutment with the wall. This has two disadvantages. First, the spacing between the adjacent part of the ladder and the wall is reduced so that the movement towards the wall caused by the flexing of the ladder below the device is increased, leading to greater movement and instability of the climbing user. Secondly, the normal reaction between the wall and a device at the point of abutment provides an upward turning moment on the device about its point of attachment to the ladder, and this moment increases as the flexing of the ladder increases. There is a danger that the turning moment may cause the device to slip up the wall thus reducing the coefficient of friction to its characteristic kinetic value and to bend or become detached from the ladder thereby leaving the ladder unsupported to crash against the wall, or perhaps even against a window facing the upper ends of its stiles.

In accordance with a second aspect of the invention, which may be used with or without the previously described inventive features according to the first aspect of the invention, a device for use in resting the upper part of a ladder against a wall comprises a frame which is provided with means for mounting the frame on a ladder, the frame having parts extending rearwardly, in use, from the ladder and carrying means for abutment with a wall, characterised in that, in normal use with the device fitted to a ladder which is under load and resting via the device at 15° to a vertical wall, the abutment means abuts the wall at a level below that at which the load of the ladder is applied to the device whereby, when the part of the ladder below the device flexes, in use, convexly towards the wall, the device rocks downwardly on the abutment means to increase the spacing of the adjacent part of the ladder from the wall.

With this arrangement any rocking of the device about the abutment with the wall, resulting in an increase in the bowing of the ladder below the device, causes the spacing of the adjacent part of the ladder from the wall to be increased, thereby compensating for the movement on the user resulting from the bowing of the ladder towards the wall. It also decreases the turning moment on the device about its point of attachment to the ladder so that there is less rather than more danger of the device slipping on the wall.

In the optimum arrangement, as seen in side elevation, a line joining the lower part of abutment with the wall and the point at which the load of the ladder is applied to the device is at substantially 90° to the length of the ladder.

Two examples of devices constructed in accordance with the present invention are illustrated in the accompanying drawings, in which.

Figure 2:
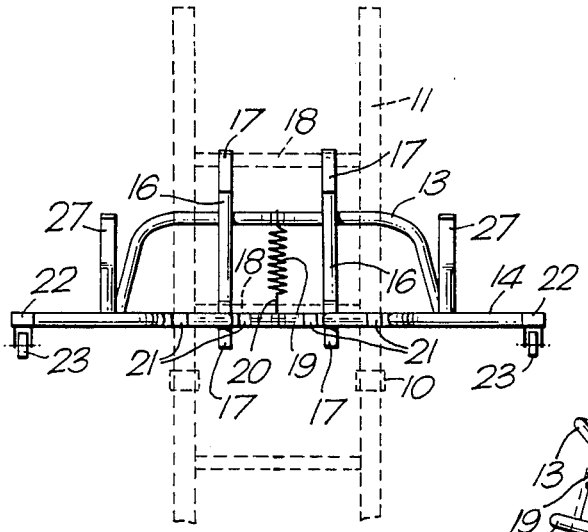
FIG. 2 is a rear elevation of the first device in use.
Figure 1:
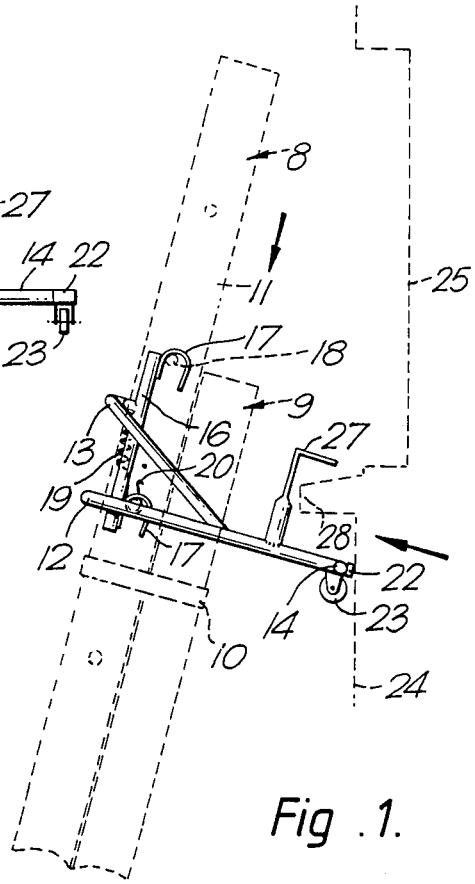
FIG. 1 is a side elevation of one device in use.
Figure 3:
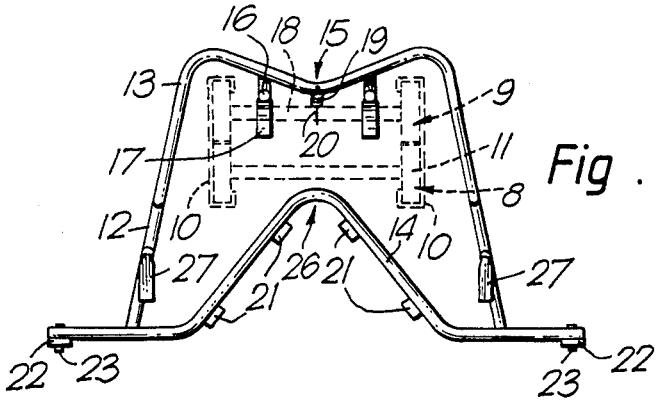
FIG. 3 is a view looking down the ladder of the first device in use.

The first device illustrated in FIGS. 1 to 3 is shown fitted to an extendible ladder having an upper section 8 and a lower section 9, the lower section having conventional hooks 10 for guiding the relative sliding of the stiles 11 of the upper section 8. The device itself comprises a frame formed by a U-shaped yoke 12, a U-shaped supporting yoke 13 and a connecting part 14. Front parts of the yokes 12 and 13 are angularly indented as shown at 15 in FIG. 3 and these front parts are fixed to a pair of bars 16 each of which carries a vertically spaced pair of hooks 17. The frame is fitted around the ladder and mounted on the upper section 8 by hooking the hooks 17 over an adjacent pair of rungs 18 and securing the mounting by extending a spring element 19 having a hook 20 which is then hooked around the lower of the two rungs 18.

The indented front parts of the yokes then effectively extend away from one another, slightly away from the ladder rungs and with a clearance past the front edges of the stiles 11. The arms of the yokes then extend with a clearance rearwardly past the outsides of the ladder stiles, the ends of the yoke 13 being fixed to the arms of the yoke 12 partway along the length of the latter and the ends of the yoke 12 being fixed to the connecting part 14. The clearance around the front and sides of the stiles is sufficient to clear not only the stiles 11 of the upper section 8, but also the stiles of the lower section 9 and the guide hooks 10 of the lower section. There is therefore no interference to complete retraction of the upper section 8, which carries the device, down to a position flush with the upper end of the lower section 9.

The free ends of the connecting part 14 carry respective frictional buffers 22 and wheels 23. As will be appreciated from FIG. 1, in normal use with the arms of the yoke 12 extending substantially perpendicularly to the length of the ladder, the buffers 22 rest in frictional engagement with a wall 24. However, if the inclination of the ladder to the wall is reduced, the wheels 23 come into engagement with the wall to allow free running up and down the wall.

The device is shown being used as a stand off device resting against the wall below a window 25 so that the user may mount the ladder and stand conveniently at the level of support against the wall.

The connecting part 14 is shown with an angular indentation 26 to allow the device to straddle a down pipe or other projection on the wall. It may also be used to embrace a corner of a wall, although in that case buffers 21 will engage the relatively perpendicular wall surfaces.

The arms of the yoke 12 are shown carrying L-shaped projections 27 which may be used with the upper flanges of the L projecting over a windowsill 28, in order to engage the windowsill in the event of the top end of the ladder slipping downwards or sideways across the wall surface.

Figure 4:
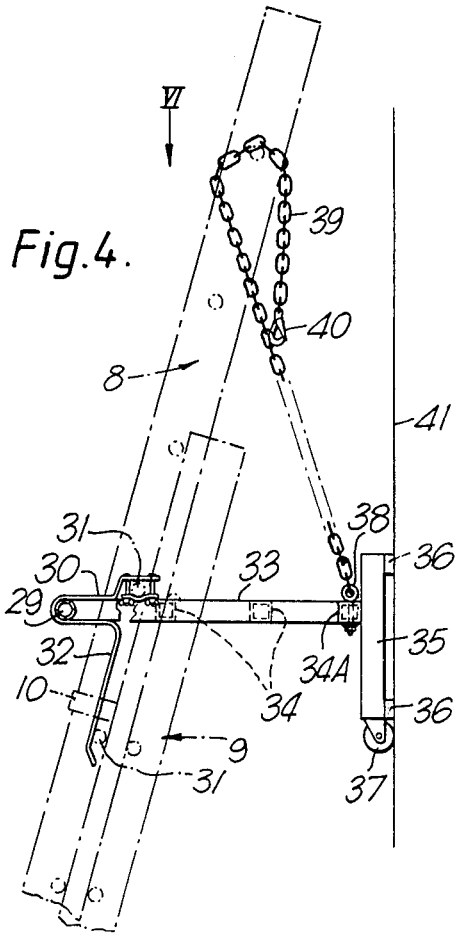
FIG. 4 is a section of the second device in use, taken on the line IV—IV in FIG. 5.
Figure 5:
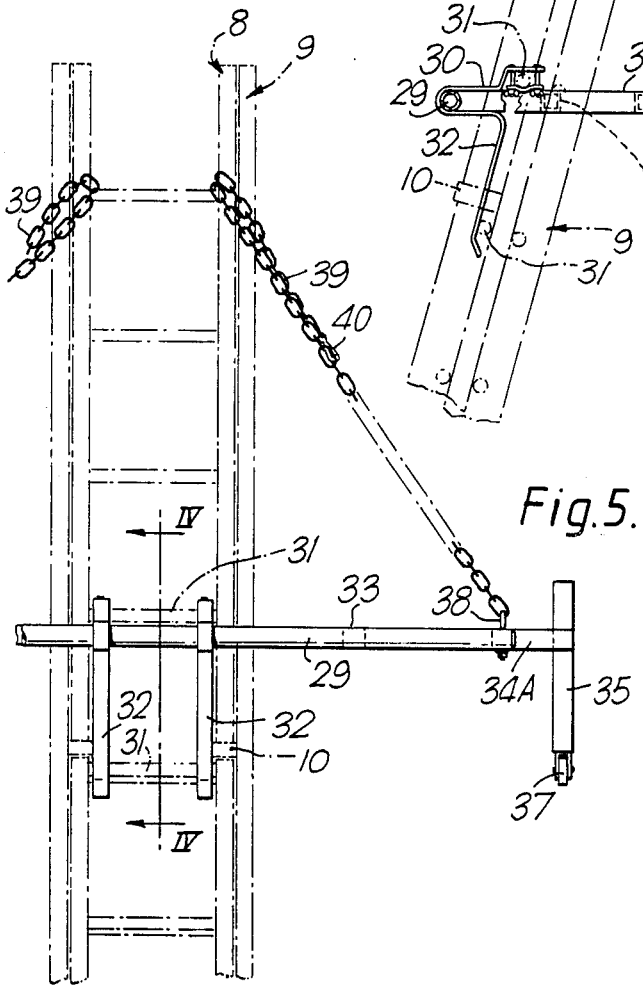
FIG. 5 is a front elevation of part of the second device in use.
Figure 6:
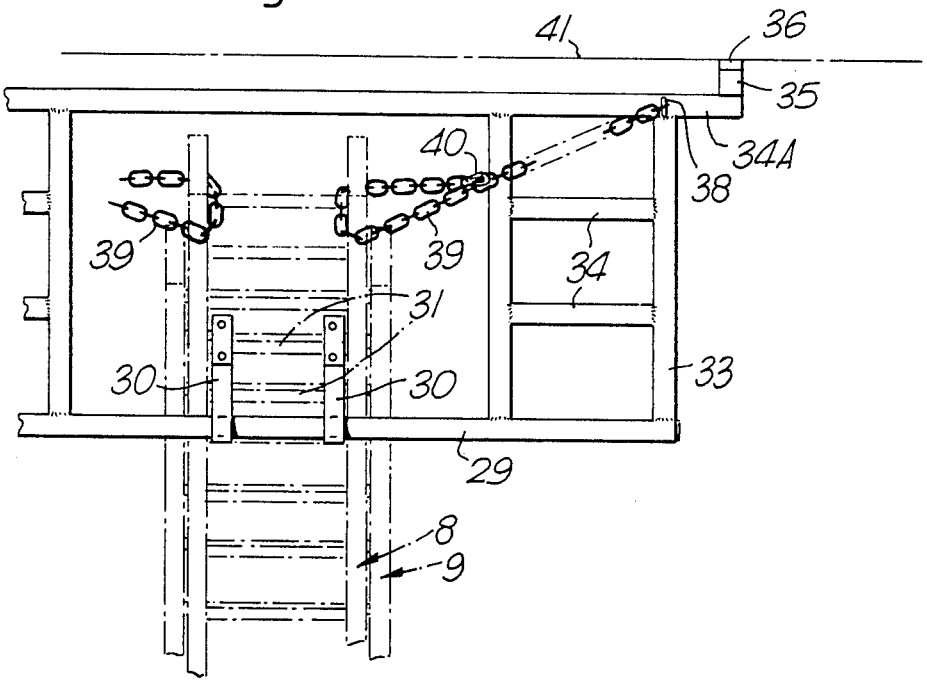
FIG. 6 is a plan of the same part of the second device in use.

The second device illustrated in FIGS. 4 to 6 is also shown mounted on an upper section 8 of an extendible ladder. In this example the stiles of the upper section 8 run on the rungs of, and between the stiles of, the lower section 9, instead of on the stiles of the lower sections as in the first example. The device comprises a tube 29 carried by a pair of rearwardly extending brackets 30 which are each clamped around a rung 31 of the ladder section 8 and has a depending leg 32 engaging the front of a lower rung 31 to prevent downward swinging of the tube 29 in the event of the brackets 30 becoming loose. The legs 32 also hold the tube 29 in a position spaced sufficiently in front of the ladder stiles to prevent interference with the guide furniture of the lower ladder section 9 when the ladder is fully retracted.

Adjacent to each free end of the tube 29, a fabricated staging unit is pivotally mounted about the axis of the rod 29 but axially restrained relatively to the rod. The staging unit consists of pairs of upper and lower strips 33 interconnected by transverse box sections 34. The rear box section 34A extends fully across the back of the device and forms a connecting part common to both staging units. At each projecting end, the part 34A carries a further length of box section 35, on which are mounted upper and lower frictional buffers 36 and a wheel 37.

Each staging unit has an eye 38 to which is connected a length of chain 39 terminating in a dog clip 40.

It will be appreciated that the tube 29, staging units and rear part 34A form a frame surrounding the ladder but clear of any interference with the lower ladder section 9 and its furniture, and any further lower ladder section, upon retraction of the ladder. In normal use the chains 39 are passed around a ladder rung above the staging and clipped back on themselves to support the staging units and part 34A in their horizontal rearwardly projecting position shown. In this position the frictional buffers 36 engage a wall 41 and a user may conveniently stand on either of the staging units. If the inclination of the ladder is reduced the frictional buffers are disengaged from the wall 41 to enable the wheels to facilitate extending and retracting of the ladder against the wall. Release of the chains 39 enables the staging units and part 34A to be swung downwards against the back of the ladder to a transport position.

Figure 7:
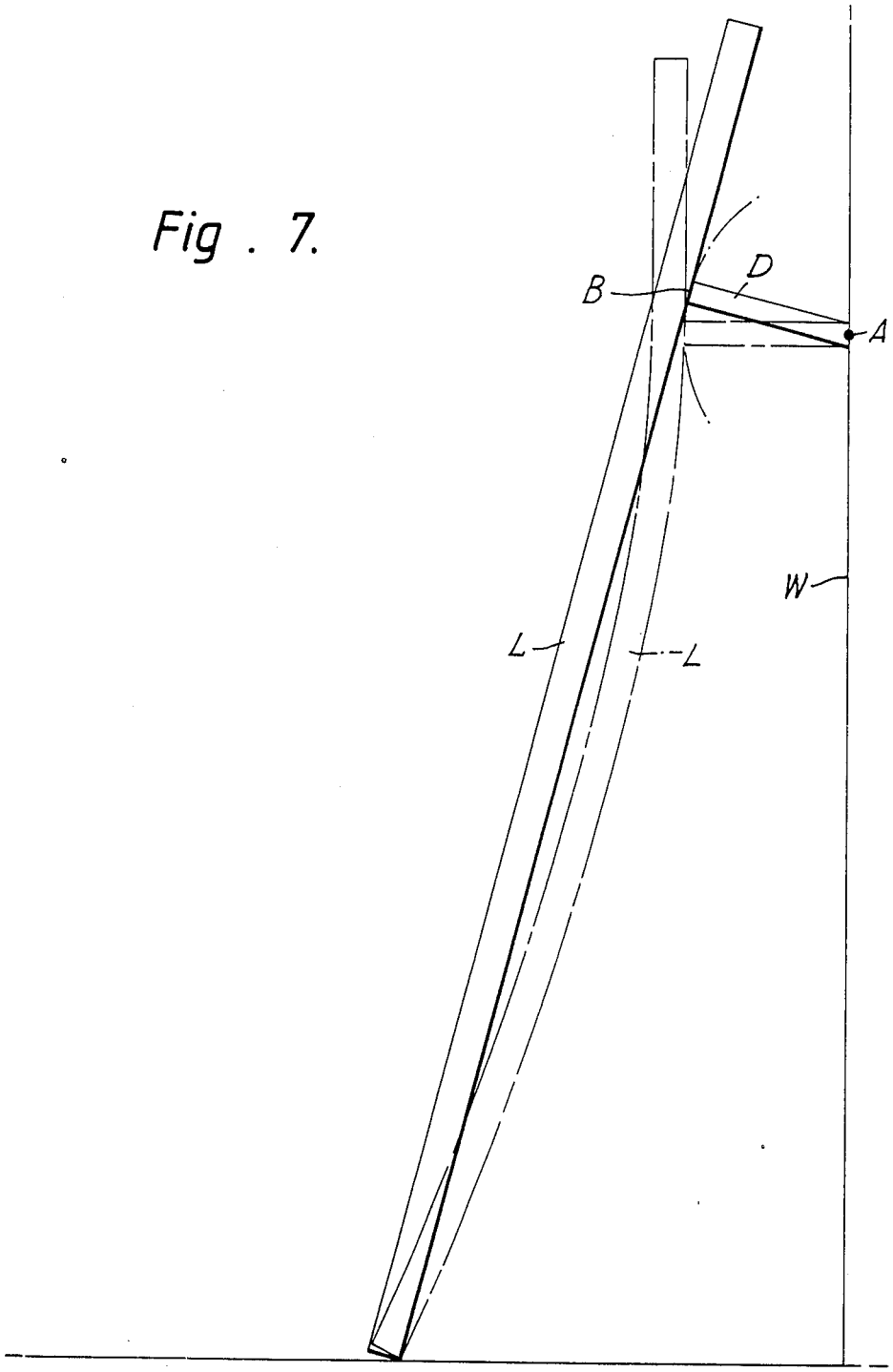
FIG. 7 is a diagram showing flexure of a ladder fitted with one of the devices.

In the normal working position of a ladder, that is at 15° to a vertical wall, both the abutments 22 in the first device and the lower abutments 36 in the second device engage the wall at a level below the level of the lower hook 17 or the tube 29, and the level at which the load of a user standing on the ladder below the device is transmitted to the device. This is shown diagrammatically in FIG. 7, in which the load on a ladder L is applied to a rest device D at a load bearing position B and the device bears against a wall W at abutment point A. FIG. 7 shows in full lines the preferred unloaded arrangement in which A is below the level of B. When, as shown in chain dotted lines, additional load of a user is applied to the ladder below the device D, the ladder bows towards the wall. This causes the device D to swing downwards about the point A, bringing the point B further away from the wall and reducing the bending moment about the point B of the normal reaction at the point A between the wall and the device D.

I claim:

1. A device for use in resting an upper part of a ladder against a wall, the device comprising a frame which is provided with means for mounting the frame on at least one rung of the ladder at a position on the rung located between the ladder stiles, the frame having first parts extending away from one another, in use, transversely across respective ones of the ladder stiles on the front climbing side of the ladder and second parts extending rearwardly from the first parts, in use, at the sides of the ladder and carrying means for abutment with a wall; characterised in that the second parts of the frame are interconnected by a further part whereby, in use, the frame completely surrounds the ladder to which it is fitted, and the mounting means and first frame parts are so arranged that, in use, when the device is mounted a few rungs down from the top of an upper section of an extendible ladder at a position below guide furniture on a lower ladder section when the ladder is retracted, the frame can ride past the lower section and guide furniture upon extension and retraction of the ladder.

2. A device according to claim 1 in which the second parts of the frame incorporate staging whereby, in use, a user may stand on the staging.

3. A device according to claim 1, in which the frame is arranged to be rigidly mounted on a ladder by means of mounting means in the form of two hooks which are fixed to the first frame parts and are engageable over different rungs of the ladder.

4. A device according to claim 3, in which the first and second frame parts comprise a pair of yokes which are arranged to extend across the front of the ladder, one above the other, and rearwardly where they are fixed together at the sides of the frame.

5. A device according to claim 4, in which the hooks are fixed to bars which interconnect the two yokes.

6. A device according to claim 1, in which at least the rearwardly projecting parts of the frame are pivotally mounted about a horizontal axis, in use, parallel to the rungs of a ladder on which the device is mounted, so that these parts may be folded towards the back of the ladder, and a tension member is connected to these parts and arranged to engage a part of the ladder above the device to restrain the pivotally mounted parts in their rearwardly projecting working position.

7. A device according to claim 1, in which the further part is indented to enable the frame to straddle a wall projection.

8. A device according to claim 1, in which the rearwardly projecting parts of the frame carry fixed frictional abutment means for working engagement with the wall.

9. A device according to claim 1, in which the rearwardly projecting parts of the frame carry wheel abutment means for running up and down the wall.

10. A device according to claim 8, in which the fixed frictional abutment means is above the wheel abutment means.

11. A device according to claim 10, in which the fixed frictional abutment means is engaged with the wall in normal use.

12. A device according to claim 10, in which the wheel abutment means is engaged with the wall in normal use.

13. A device according to claim 1, in which in normal use with the device fitted to a ladder which is under load and resting via the device at 15° to a vertical wall, the abutment means abuts the wall at a level below that at which the load of the ladder is applied to the device whereby, when the part of the ladder below the device flexes, in use, convexly towards the wall, the device rocks downwardly on the abutment means to increase the spacing of the adjacent part of the ladder from the wall.

14. A device according to claim 13, in which, as seen in side section, a line adjoining the lowest point of abutment with the wall and the point at which the load of the ladder is applied to the device is at substantially 90° to the length of the ladder.

15. An extendible ladder, the upper section of which is fitted with a device according to claim 1 .

* * * * *